US006932142B2

(12) United States Patent
Ban

(10) Patent No.: US 6,932,142 B2
(45) **Date of Patent: *Aug. 23, 2005**

(54) REDUCTION CASTING METHOD

(75) Inventor: Keisuke Ban, Nagano-ken (JP)

(73) Assignee: Nissin Kogyo Co., Ltd., Nagano (JP)

( * ) Notice: Subject to any disclaimer, the term of this patent is extended or adjusted under 35 U.S.C. 154(b) by 91 days.

This patent is subject to a terminal disclaimer.

(21) Appl. No.: 10/384,717

(22) Filed: Mar. 11, 2003

(65) Prior Publication Data

US 2003/0173050 A1 Sep. 18, 2003

(30) Foreign Application Priority Data

Mar. 13, 2002 (JP) ..... P.2002-068211

(51) Int. Cl.[7] ..... B22D 27/00; B22D 27/18
(52) U.S. Cl. ..... 164/56.1; 164/67.1; 164/72
(58) Field of Search ..... 164/56.1, 66.1, 164/67.1, 61, 72, 122.1

(56) References Cited

U.S. PATENT DOCUMENTS 6,745,816 B2 * 6/2004 Ban et al. ..... 164/56.1
6,745,817 B2 * 6/2004 Ban et al. ..... 164/56.1

FOREIGN PATENT DOCUMENTS

| | | |
|---|---|---|
| EP | 1 145 787 A1 | 10/2001 |
| EP | 1 153 678 A1 | 11/2001 |
| JP | 2000-280063 | 10/2000 |
| JP | 2000280063 | 10/2000 |

OTHER PUBLICATIONS

European Search Report dated May 19, 2004.

* cited by examiner

*Primary Examiner*—Kuang Y. Lin
(74) *Attorney, Agent, or Firm*—Greenblum & Bernstein, P.L.C.

(57) ABSTRACT

A reduction casting method includes the steps of: pouring a molten metal into a cavity of a molding die; and performing casting while reducing an oxide film formed on a surface of the molten metal by allowing the molten metal and a reducing substance to come into contact with each other in the cavity. On this occasion, the molten metal is poured into the cavity in a state in which the molding die is forcibly cooled by a cooling device, thereby being rapidly cooled. Further, on this occasion, a solidification speed at which the molten metal is rapidly cooled is allowed to be 600° C./min or more. Still further, on this occasion, the molten metal is filled into the cavity in a filling time of from 1.0 second to 9.0 seconds.

20 Claims, 2 Drawing Sheets

REDUCTION CASTING METHOD

BACKGROUND OF THE INVENTION

1. Field of the Invention

The present invention relates to a reduction casting method. More particularly, the invention relates to a reduction casting method that eliminates a state in which a molten metal is not fully filled into the cavity and is capable of shortening a casting cycle.

There are various types of casting methods such as a gravity casting method (GDC), a low pressure die casting method (LPDC), a die casting method (DC), a squeeze casting method (SC) a thixomolding method. All of these methods perform casting by pouring molten metal into a cavity of a molding die, thereby molding the thus-poured molten metal into a predetermined shape. Among these casting methods, in a method in which an oxide film is likely to be formed on a surface of the molten metal, for example, at aluminum casting or the like, a surface tension of the molten metal is increased by the oxide film formed on the surface of the molten metal to deteriorate a flowing property, a running property and an adhesive property of the molten metal thereby causing problems of casting imperfections such as insufficient filling, a surface fold and the like.

As a method to solve these problems, the present applicant has proposed a reduction casting method which is capable of performing casting by reducing an oxide film formed on a surface of a molten metal (for example, JP-A-2000-280063). In this reduction casting method, a magnesium-nitrogen compound ($Mg_3N_2$) having a strong reducing property is produced by using a nitrogen gas and a magnesium gas and, then, the thus-produced magnesium-nitrogen compound is allowed to act on the molten metal of aluminum, thereby performing casting. By pouring the molten metal into a cavity of a molding die in a state in which the magnesium-nitrogen compound is deposited on a surface of the cavity of the molding die, when the molten metal comes into contact with the surface of the cavity, an oxide film formed on the surface of the molten metal is reduced by a reducing action of the magnesium-nitrogen compound to form the surface of the molten metal with pure aluminum, thereby decreasing a surface tension of the molten metal and, accordingly, enhancing a flowing property of the molten metal. As a result, a running property of the molten metal becomes advantageous, whereby a cast product which does not have a cast imperfection but has an excellent appearance without a surface fold or the like can be obtained.

Further, by a subsequent study, according to the reduction casting method, it was found that casting can be performed while holding a temperature of the molding die at low temperature at the time of casting.

Namely, since the flowing property and the running property of the molten metal become extremely advantageous when the reduction casting method is adopted, it is not necessary to hold the temperature of the molding die at high temperature different from other casting methods such as a gravitational casting method (GDC). A reason why the molding die is held warm at the time of casting in the gravitational casting method and the like is to secure the flowing property of the molten metal which fills the cavity by elevating the temperature of the molding die as high as possible. On the other hand, the reduction casting method is excellent in the flowing property and the running property of the molten metal, whereby a filling operation of the molten metal into the cavity is completed in a few seconds.

Therefore, in the reduction casting method, it is not necessary to hold the temperature of the molding die at high temperature as is done in a conventional casting method. Rather, it is advantageous from the standpoint of capability of shortening a cycle time of casting that the molten metal poured in the cavity is allowed to be solidified as fast as possible by decreasing the temperature of the molding die as much as possible.

However, problems were generated in that, since the solidification speed of the molten metal became faster, the molten metal was solidified before the molten metal went sufficiently around in the cavity.

SUMMARY OF THE INVENTION

Under these circumstances, the present invention has been achieved to solve these problems, and an object of the invention is to provide a reduction casting method which can determine a relation between the solidification speed and the filling time of the molten metal, eliminate the state in which the molten metal is insufficiently filled into the cavity and shorten the cycle time of casting.

[Means for Solving the Problems]

In order to attain the object, the invention has a constitution described below.

Namely, according to the invention, there is provided a reduction casting method, comprising the steps of:

pouring a molten metal into a cavity of a molding die wherein the molten metal is poured into the cavity in a state in which the molding die is forcibly cooled by a cooling device, whereby the molten metal is rapidly cooled; and performing casting while reducing an oxide film formed on a surface of the molten metal by allowing the molten metal and a reducing substance to come into contact with each other in the cavity, wherein a solidification speed at which the molten metal is rapidly cooled is allowed to be 600° C./min or more; and wherein the molten metal is filled into the cavity in a filling time of from 1.0 second to 9.0 seconds. On this occasion, a DASII value is preferably allowed to be 22 $\mu$m or less.

More preferably, the solidification speed of the molten metal is allowed to be 800° C./min or more. On this occasion, the DASII value is preferably allowed to be 20 $\mu$m or less.

Preferably, a pouring time of the molten metal is adjusted to be from 1.0 second to 9.0 seconds by pouring the molten metal into the cavity while applying pressure.

As the reducing substance, magnesium or a magnesium-nitrogen compound ($Mg_3N_2$) can be used.

DETAILED DESCRIPTION OF THE PREFERRED EMBODIMENTS

Hereinafter, a preferred embodiment of the present invention will be described in detail with reference to accompanying drawings.

Figure 1:
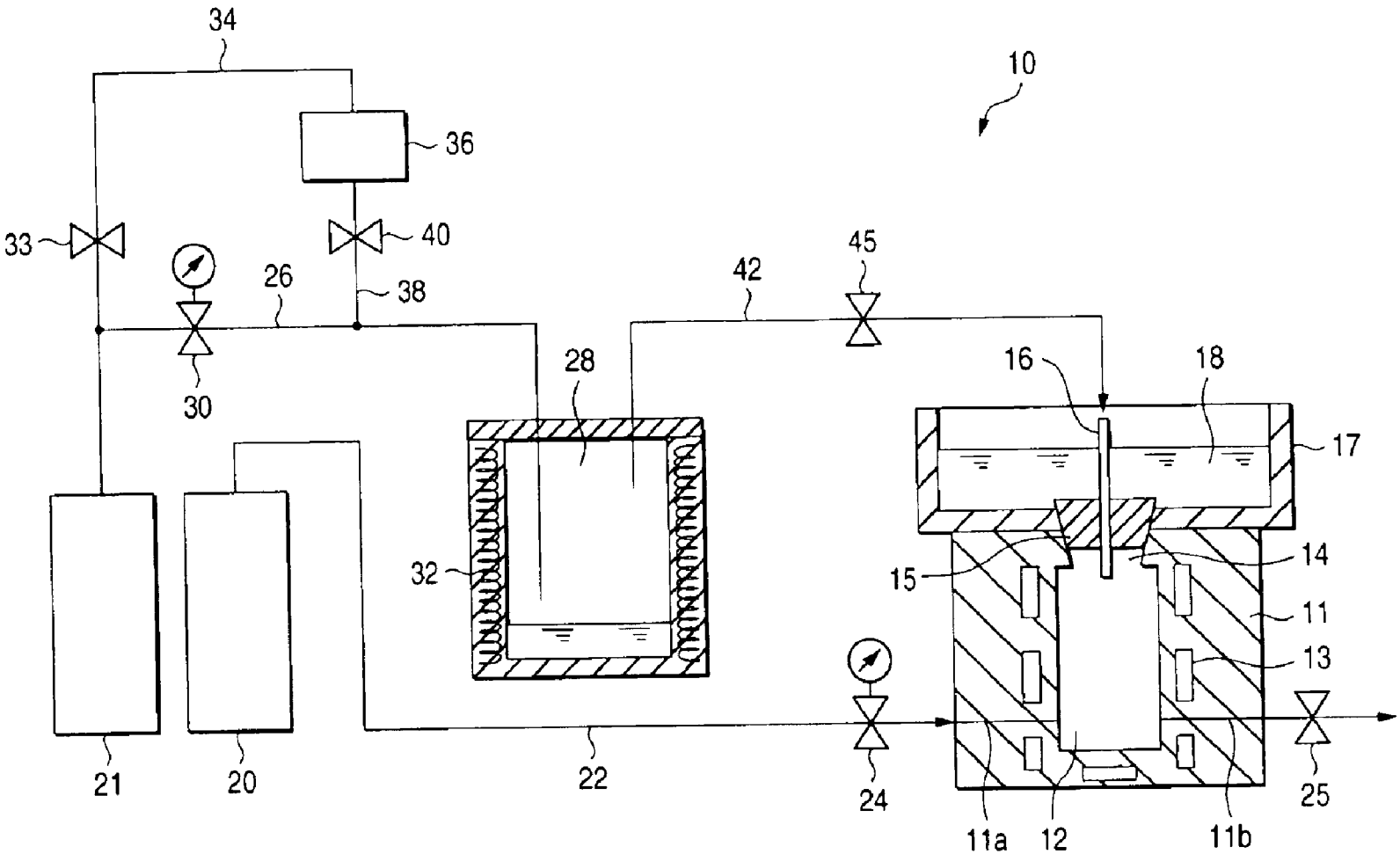
FIG. 1 is an explanatory diagram illustrating an example of a constitution of a casting apparatus which performs casting by a reduction casting method according to the present invention.

FIG. 1 is an explanatory diagram showing an entire constitution of a casting apparatus 10 for performing casting by utilizing a reduction casting method according to the invention. An application thereof for aluminum casting is illustrated below; however, the invention is by no means limited to the aluminum casting.

In FIG. 1, reference numerals 11 and 12 denote a molding die and a cavity formed inside the molding die 11, respectively. In an upper part of the cavity 12, a sprue 14 shaped in a state of a tapered surface which becomes gradually smaller downward in diameter is provided. In the sprue 14, a plug 15 is detachably provided. A reference numeral 16 denotes a pipe which is vertically formed to pass through the plug 15.

A reference numeral 17 denotes a reservoir for containing the molten metal to be poured (hereinafter also referred to simply as "molten metal reservoir") provided in the upper part of the molding die 11. The molten metal reservoir 17 and the cavity 12 are communicated with each other via the sprue 14. By performing an opening/closing operation of the plug 15, pouring of the molten metal into the cavity 12 is controlled. In a case of the present embodiment which illustrates the application of the reduction casting method according to the invention to the aluminum casting, the molten metal of aluminum is stored in the molten metal reservoir 17.

Materials for the molding die 11 are not particularly limited; however, the molding die 11 may be formed by using a material having favorable thermal conductivity. Further, the molding die 11 is provided with a cooling device with which it is forcibly cooled. In the embodiment, as the cooling device, a flow passage 13 is provided inside the molding die 11 such that cooling-water is allowed to constantly run through the flow passage 13. A reason for forming the molding die 11 by using the material having favorable thermal conductivity and constantly forcibly cooling the molding die 11, is to hold a temperature thereof to be as low as possible. Therefore, so long as a cooling method is such that the temperature of the molding die 11 is effectively held to be low, the cooling method is not necessarily limited to such a water-cooling-method as described above. It goes without saying that a plurality of cooling devices can simultaneously be used in combination.

In FIG. 1, a reference numeral 20 denotes a steel cylinder 20 for containing a nitrogen gas (hereinafter also referred to "nitrogen gas-containing steel cylinder"). The nitrogen gas-containing steel cylinder 20 is connected to the molding die 11 via a piping system 22 in which a valve 24 is interposed and is arranged such that the nitrogen gas is allowed to be introduced into the cavity 12 through a nitrogen gas-introducing port 11*a* provided in the molding die 11. By opening the valve 24 to feed the nitrogen gas into the cavity 12 through the nitrogen gas-introducing port 11*a*, air present in the cavity 12 is purged therefrom to produce a nitrogen gas atmosphere in the cavity 12, so that a non-oxygen atmosphere is substantially produced in the cavity 12. A reference numeral 11*b* denotes an exhaust port provided in the molding die 11. It is also possible that the non-oxygen atmosphere is produced in the cavity 12 by connecting a vacuum device to the exhaust port 11*b* via the piping system in which a valve 25 is interposed and, then, operating the vacuum device in a state in which the valve 25 is opened.

A reference numeral 21 denotes a steel cylinder for containing an argon gas (hereinafter also referred to as "argon gas-containing steel cylinder"). The argon gas-containing steel cylinder 21 is connected to a furnace 28 which is a generator for generating a metallic gas via a piping system 26. By performing an opening/closing operation of a valve 30 which is interposed in the piping system 26, pouring of the argon gas into the furnace 28 is controlled. The furnace 28 is heated by a heater 32. In the embodiment, a temperature in the furnace 28 is set to be a boiling point or less of magnesium, as well as a melting point or more of magnesium so that magnesium in the furnace 28 becomes in a liquid state.

The argon gas-containing steel cylinder 21 is also connected to a tank 36 in which magnesium metal is contained via a piping system 34 in which a valve 33 is interposed; further, the tank 36 is connected to the piping system 26 in a downstream side of the valve 30 via a piping system 38. A reference numeral 40 denotes a valve, which is interposed in the piping system 38, for use in controlling a supply quantity of magnesium to the furnace 28. The tank 36 is used for containing magnesium metal to be supplied to the furnace 28, and the magnesium metal is contained therein in powder or granular form.

The furnace 28 is connected to the cavity 12 of the molding die 11 via a piping system 42 and the pipe 16 which is attached to the plug 15. Magnesium in gas or mist form which has been produced in the furnace 28 is introduced into the cavity 12 of the molding die 11 by performing an opening/closing operation of a valve 45 which is interposed in the piping system 42 and also controlling an argon gas pressure by the valve 30.

Aluminum casting by the casting apparatus 10 as shown in FIG. 1 is performed in a manner as described below.

Firstly, the valve 24 is opened in a state in which the sprue 14 is closed by being fitted with the plug 15 to pour the nitrogen gas from the nitrogen gas-containing steel cylinder 20 into the cavity 12 of the molding die 11 via the piping system 22. By such pouring of the nitrogen gas, air present inside the cavity 12 is purged therefrom, whereby a non-oxygen atmosphere is substantially produced in the cavity 12 and, then, the valve 24 is closed.

During a time period in which the nitrogen gas is poured into the cavity 12 of the molding die 11 or before such pouring, the valve 30 is opened to pour the argon gas from the argon gas-containing steel cylinder 21 into the furnace 28 to produce a non-oxygen atmosphere in the furnace 28. Next, the valve 30 is closed and the valves 33 and 40 are opened to send the magnesium metal contained in the tank 36 into the furnace 28 by an argon gas pressure applied from the argon gas-containing steel cylinder 21. Since the furnace 28 is heated at a temperature at which the magnesium metal is melt, the magnesium metal which has been sent in the furnace 28 turns to be in a molten state therein. Since the magnesium gas is sent out from the furnace 28 in a repeated manner every time a casting operation is performed, a certain quantity of magnesium metal which can corresponds to such operations is sent from the tank 36 to the furnace 28. After the magnesium metal is sent in the furnace 28, valves 33 and 40 are closed.

Subsequently, the valves 30 and 45 are opened to pour the magnesium gas from the furnace 28 into the cavity 12 of the molding die 11 via the pipe 16 by using the argon gas as a carrier gas while controlling pressure and a flow quantity of the argon gas. On this occasion, magnesium in mist form is also sent out from the furnace 28 together with the magnesium gas.

After the magnesium gas is poured into the cavity 12, the valve 45 is closed and, then, the valve 24 is opened to pour the nitrogen gas into the cavity 12 through the nitrogen gas-introducing port 11*a*. By pouring the nitrogen gas into the cavity 12, the magnesium gas previously poured in the cavity 12 and the thus-poured nitrogen gas are allowed to react with each other in the cavity 12 to produce the magnesium-nitrogen compound ($Mg_3N_2$) which is a reducing compound. The magnesium-nitrogen compound is primarily deposited on a surface of an inner wall of the cavity 12.

In a state in which the magnesium-nitrogen compound is produced on such inner wall surface of the cavity 12, the plug 15 is opened to pour the molten metal 18 from the sprue 14 into the cavity 12.

The molten metal 18 of aluminum thus poured in the cavity 12 comes into contact with the magnesium-nitrogen compound produced on the inner wall surface of the cavity 12 so that the magnesium-nitrogen compound deprives oxygen from an oxide film formed on a surface of the molten metal to reduce the surface of the molten metal, to pure aluminum which is, then, filled into the cavity 12 (reduction casting method). By allowing the oxide film formed on the surface of the molten metal to be reduced, pure aluminum is exposed on the surface of aluminum, whereby the flowing property of the molten metal becomes extremely favorable.

Since the running property of the molten metal becomes, accordingly, extremely favorable, there is a merit in that it is neither necessary to use a conventional heat-insulating coating agent nor necessary to hold the molding die in high temperature.

Further, in a case of the reduction casting method as described above, since the molten metal 18 is filled into the cavity 12 in a short period of time, it is effective to cool the molten metal 18 which has been filled into the molding die 11 and solidify it in a short period of time. When the molding die 18 is made of a material having a favorable thermal conductivity, so long as the temperature of the molding die 18 is held at a temperature or less at which the molding die 18 can have a sufficient hardness, for example, about 150° C. or less, casting can be performed by a casting method which uses the molding die made of such material, while preventing scoring from being generated in contact with the molten metal.

It is favorable that a solidification speed of the molten metal is set to be 600° C./minute or more (temperature decrease per unit time of the molten metal in the molding die 11) and preferably 800° C./minute or more. As the solidification speed is larger, a crystal structure of the cast product becomes denser; this feature is favorable since strength thereof is enhanced.

This solidification speed is in neighborhood of that of a conventional DC. However, this reduction casting method does not rely on rapid cooling as is done in a splash or spraying filling of the DC but is capable of performing filling of the molten metal in a stratified or a partially turbulent state to allow an inner quality to be extremely favorable, a DASII value to be also small and expansion, strength and the like to be enhanced.

Figure 2:
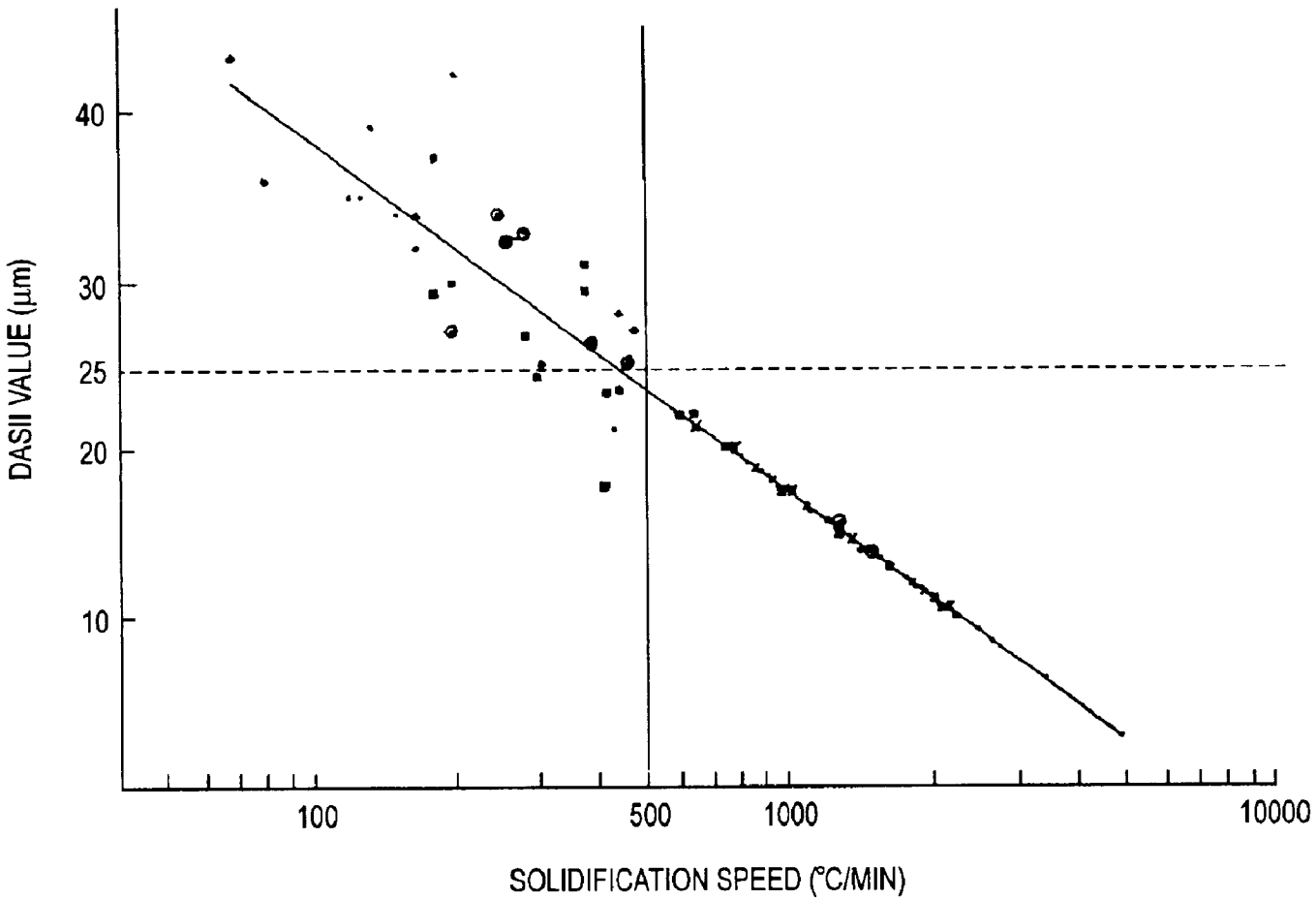
FIG. 2 is a graph showing, in regard to an aluminum material, a measurement result as to how DASII value varies in accordance with a solidification speed of a molten metal.

FIG. 2 shows a result of measurement as to how a space between dendrites in a solidified body is changed when the solidification speed of the molten metal is changed in aluminum casting.

The measurement was performed such that a portion of aluminum which has been filled into and solidified in the cavity 12 was taken out to be a sample and a space between dendrites thereof was measured by an electronic microscope. In FIG. 2, the solidification speed is shown in abscissa and the space between dendrites of solidified aluminum was shown in ordinate as "DASII value".

From FIG. 2, when the solidification speed is 600° C./min or more, the space between the dendrites of aluminum filled into and solidified in the cavity 12 becomes 22 μm or less in an average, while, when the solidification speed is 800° C./min or more, the space between the dendrites becomes 20 μm or less in an average.

The space between the dendrites of aluminum relates to density of the solidified body (cast product) and, as the space between the dendrites becomes smaller, the crystal structure of aluminum becomes denser, so that mechanical strength of the cast product obtained is enhanced.

From the standpoint of mechanical strength, the DASII value is 22 μm or less and preferably 20 μm or less.

Next, the filling time of the molten metal is studied.

The filling time of the molten metal is determined depending on a relation between a material of a cast alloy and the solidification speed.

Ordinarily, at the time of cooling the cast alloy such as AC2B and AC4B, there is a temperature difference of about 90° C. (decrease of 90° C.) between a temperature in the beginning of filling the molten metal and a temperature at completion of forming an α type dendrite crystal structure. Namely, by a temperature decrease of 90° C., solidification is can be performed. During this solidifying time period, it is necessary to complete filling of the molten metal into the cavity 12. When the solidification speed is set to be from 600° C./min to 2000° C./min, the filling time of the molten metal becomes from 9.0 seconds to 2.7 seconds.

On the other hand, at the time of cooling alloys for casting such as 2017, 2024 and 2618, there is a temperature difference of about 40° C. between a temperature in the beginning of filling the molten metal and a temperature at completion of forming the a type dendrite structure.

When the solidification speed is set to be from 600° C./min to 2000° C./min, the filling time of the molten metal becomes from 4.0 seconds to 1.2 second.

Namely, although there is a difference depending on materials to be used in the cast alloy, unless the filling of the molten metal into all parts of the cavity 12 is completed in a period of from about 1.0 second to about 9.0 seconds, a part of the molten metal in the cavity 12 starts to be solidified, thereby generating an insufficiently filled part.

Practically, among all parts of the cavity 12, there are some parts which are thick and other parts which are thin, namely, all parts are not necessarily uniform in thickness. The molten metal first runs into a thick part and, in late, into a thin part in which the solidification speed is fast and thus, there is a fear that solidification starts before the filling into the thin part is completed.

Therefore, it is necessary to perform controlling such that filling of the molten metal into all parts of the cavity 12 is completed.

In a case in which there is a thin part into which the molten metal is hard to run or other cases, it is favorable that the molten metal is applied with pressure by some device which is not limited to any particular type and all parts of the cavity 12 are filled with molten metal within a predetermined time in a same manner as in LPDC. For this reason, it is also important to appropriately select a diameter, a shape, a position, a number and the like of the sprue.

By performing controlling such that filling of the molten metal into all parts of the cavity 12 is completed, since the running property is favorable by nature, the molten metal is allowed to be assuredly filled even into a fine part of the cavity 12 whereby cast imperfections to be caused by, for example, insufficient filling can be eliminated. Further, since the oxide film formed on the surface of the molten metal is removed, a surface fold or the like is not generated on the surface of the cast product whereby the cast product having an excellent appearance can be obtained.

In the above-described embodiment, the magnesium gas, the nitrogen gas were directly introduced into the cavity to generate the magnesium-nitrogen compound; however, it is also permissible that a reaction chamber (not shown) is provided immediately in front of the molding die and, then, the argon gas, the magnesium gas and the nitrogen gas were introduced into the thus-provided reaction chamber to allow these gases to react there among in the reaction chamber and to generate the magnesium-nitrogen compound and, thereafter, the thus-generated magnesium-nitrogen compound is introduced into the cavity.

Further, the embodiment was explained with reference to the magnesium-nitrogen compound as the reducing substance of the molten metal, but a single body of magnesium or other reducing substances may also be used. As for the carrier gas, other inert gases or non-oxidizing gases than the argon gas may also be used.

Still further, although the aluminum casting method was explained in the embodiment but the method according to the invention is not limited thereto but is applicable to casting methods in which aluminum alloys, various types of metals such as magnesium and iron and alloys thereof are each used as a casting material.

According to the invention, as described above, by controlling the solidification speed of the molten metal, filling time of the molten metal and the like such that filling of the molten metal into all parts of the cavity is completed, since the running property is favorable by nature, the casting cycle can be shortened and the molten metal can assuredly be filled even into a fine part of the cavity whereby cast imperfections to be caused by, for example, insufficient filling can be eliminated. Further, since the oxide film formed on the surface of the molten metal is removed, the surface fold or the like is not generated on the surface of the cast product, thereby allowing to obtain the cast product having a excellent appearance.

What is claimed is:

1. A reduction casting method, comprising the steps of:

pouring a molten metal into a cavity of a molding die in a state in which the molding die is forcibly cooled by a cooling device, whereby the molten metal is rapidly cooled; and performing casting while reducing an oxide film formed on a surface of the molten metal by allowing the molten metal and a reducing substance to come into contact with each other in the cavity, wherein a solidification speed at which the molten metal is rapidly cooled is set to be 600° C./min or more; and wherein the molten metal is filled into the cavity in a filling time of from 1.0 second to 9.0 seconds.

2. The reduction casting method as set forth in claim 1, wherein a DASII value is allowed to be 22 $\mu$m or less by setting the solidification speed of the molten metal to be 600° C./min or more.

3. The reduction casting method as set forth in claim 1, wherein the solidification speed is set to be 800° C./min or more.

4. The reduction casting method as set forth in claim 1, wherein the DASII value is allowed to be 20 $\mu$m or less by setting the solidification speed of the molten metal to be 800° C./min or more.

5. The reduction casting method as set forth in claim 1, wherein a pouring time of the molten metal is adjusted to be from 1.0 second to 9.0 seconds by pouring the molten metal into the cavity while pressurizing the molten metal.

6. The reduction casting method as set forth in claim 1, wherein the reducing substance is magnesium.

7. The reduction casting method as set forth in claim 1, wherein the reducing substance is a magnesium-nitrogen compound ($Mg_3N_2$).

8. The reduction casting method as set forth in claim 1, wherein the cooling device cools so that the molding die is held in 150° C. or less at the time of casting.

9. The reduction casting method as set forth in claim 1, wherein the solidification speed is set to be in a range of 600–2000° C./min.

10. The reduction casting method as set forth in claim 1, further comprising the steps of purging air from the cavity to place the cavity in a non-oxygen atmosphere.

11. The reduction casting method as set forth in claim 1, further comprising mixing agents to form the reducing substance in the cavity such that the reducing substance contacts the surface of an inner wall of the cavity which deprives oxygen from the oxide film fanned on a surface of the molten metal to reduce the surface of the molten metal.

12. The reduction casting method as set forth in claim 1, further comprising filling of the molten metal in a partially turbulent state.

13. The reduction casting method as set forth in claim 1, further comprising applying pressure to force the molten metal in the cavity during the pouring step.

14. A reduction casting method, comprising the steps of:

pouring a molten metal into a cavity of a molding die in a pressurized state;

forcibly cooling the molten metal during casting to maintain a temperature of the molding die at a predetermined temperature and lower at the time of casting;

reducing an oxide film formed on a surface of the molten metal by allowing the molten metal and a reducing substance to come into contact with each other in the cavity; and setting a solidification speed at which the molten metal is rapidly cooled to approximately 600° C./min. and more.

15. The reduction casting method as set forth in claim 14, wherein the molten metal is filled into the cavity in a filling time of from 1.0 second to 9.0 seconds.

16. The reduction casting method as set forth in claim 15, wherein:

when the solidification speed is set to be from 600° C./min to 2000° C./min, the filling time of the molten metal becomes one of from 9.0 seconds to 2.7 seconds and 4.0 seconds to 1.2 second; and the predetermined temperature at the time of casting is 150° C. or less.

17. The reduction casting method as set forth in claim 14, wherein the reducing substance is mixed from agents within the cavity, the agents include:

a first reducing agent being provided into the cavity by using a carrier gas while controlling pressure and a flow quantity of the carrier gas; and a second agent provided into the cavity to react with the first reducing agent to form the reducing substance in the cavity and which is primarily deposited on a surface of an inner wall of the cavity.

18. The reduction casting method as set forth in claim 14, wherein the reducing substance is introduced into the cavity after mixing of agents to form the reducing substance.

19. The reduction casting method as set forth in claim 14, wherein when the solidification speed is 600° C./min or more, a space between dendrites filled into and solidified in the cavity becomes on average 22 $\mu$m or less.

20. The reduction casting method as set forth in claim 14, wherein when the solidification speed is 800° C./min or more, a space between dendrites becomes on average 20 $\mu$m or less.

* * * * *

UNITED STATES PATENT AND TRADEMARK OFFICE

CERTIFICATE OF CORRECTION

PATENT NO. : 6,932,142 B2
DATED : August 23, 2005
INVENTOR(S) : K. Ban

It is certified that error appears in the above-identified patent and that said Letters Patent is hereby corrected as shown below:

Column 8,
Line 11, "fanned" should be -- formed --.

Signed and Sealed this

Twenty-fifth Day of April, 2006

JON W. DUDAS
*Director of the United States Patent and Trademark Office*